US007314358B2

(12) United States Patent
Tsuchiya

(10) Patent No.: US 7,314,358 B2
(45) Date of Patent: Jan. 1, 2008

(54) SCROLL FLUID MACHINE HAVING AN ADJUSTMENT MEMBER FOR CORRECTING AN ERROR IN ORBITING MOTION BETWEEN FIXED AND ORBITING SCROLLS

(75) Inventor: Masaru Tsuchiya, Yokohama (JP)

(73) Assignee: Anest Iwata Corporation, Kohoku-ku, Yokohama-shi, Kanagawa (JP)

( * ) Notice: Subject to any disclaimer, the term of this patent is extended or adjusted under 35 U.S.C. 154(b) by 0 days.

(21) Appl. No.: 11/716,751

(22) Filed: Mar. 12, 2007

(65) Prior Publication Data

US 2007/0212245 A1 Sep. 13, 2007

(30) Foreign Application Priority Data

Mar. 13, 2006 (JP) ..... 2006-067274

(51) Int. Cl.
*F03C 2/00* (2006.01)
*F04C 18/00* (2006.01)

(52) U.S. Cl. ..... 418/60; 418/55.3; 418/179; 464/102

(58) Field of Classification Search ..... 418/55.1–55.6, 418/57, 60, 179; 464/102
See application file for complete search history.

(56) References Cited

U.S. PATENT DOCUMENTS 4,950,138 A * 8/1990 Spinnler ..... 418/55.3
5,755,564 A * 5/1998 Machida et al. ..... 418/55.3
7,014,435 B1 * 3/2006 Yanagisawa et al. ..... 418/55.2

FOREIGN PATENT DOCUMENTS

| | | | | |
|---|---|---|---|---|
| DE | 3538522 A | * | 12/1986 | |
| DE | 4116851 A | * | 12/1991 | |
| DE | 4203347 A | * | 8/1992 | |
| JP | 05052189 A | * | 3/1993 | ..... 418/60 |
| JP | 09133086 A | * | 5/1997 | |
| JP | 2003-202030 A | | 12/2001 | |

* cited by examiner

*Primary Examiner*—Theresa Trieu
(74) *Attorney, Agent, or Firm*—Davis Bujold & Daniels, P.L.L.C.

(57) ABSTRACT

A scroll fluid machine comprises a fixed scroll, an orbiting scroll and a self-rotation-preventing device for preventing the orbiting scroll from rotating on its own axis. The self-rotation-preventing device comprises a bearing in a support hole of the orbiting scroll, a crank pin which connects the orbiting scroll to the orbiting scroll, and an adjusting member interposed between the inner circumferential surface of the support hole and the outer circumferential surface of the bearing to correct an error in orbiting motion between the two scrolls.

5 Claims, 3 Drawing Sheets

SCROLL FLUID MACHINE HAVING AN ADJUSTMENT MEMBER FOR CORRECTING AN ERROR IN ORBITING MOTION BETWEEN FIXED AND ORBITING SCROLLS

This application claims priority from Japanese Application Serial No. 2006-67274 filed Mar. 13, 2006.

BACKGROUND OF THE INVENTION

The present invention relates to a scroll fluid machine such as a scroll vacuum pump or a scroll compressor.

A scroll fluid machine comprises a fixed scroll and an orbiting scroll which engages with the fixed scroll to form a compression chamber. The orbiting scroll revolves with an eccentric axial portion of a driving shaft connected to a driving source, so that the compression chamber decreases in volume toward the center, thereby compressing fluid.

Between the fixed scroll and orbiting scroll, a self-rotation-preventing device is interposed to prevent the orbiting scroll from rotating on its own axis when the driving shaft rotates. JP2003-202030A discloses that a self-rotation-preventing device is supported by elastic materials such as an O-ring made of fluororubber in a support hole of the orbiting scroll.

However, such a scroll fluid machine is used in a chemically-attacking gas and the O-ring deteriorates for a short time not only to make impossible for the O-ring to adjust an error in orbiting motion but also to loosen engagement of the scrolls, so that smooth motion is not achieved. It is not preferable to use elastic material such as fluororubber under such severe condition.

SUMMARY OF THE INVENTION

In view of the disadvantages, it is an object of the invention to provide a scroll fluid machine that allows an error in orbiting motion between scrolls to be corrected under any severe conditions.

BRIEF DESCRIPTION OF THE DRAWINGS

The features and advantages of the invention will become more apparent from the following description with respect to an embodiment as shown in accompanying drawings wherein.

DETAILED DESCRIPTION OF PREFERRED EMBODIMENTS

Figure 1:
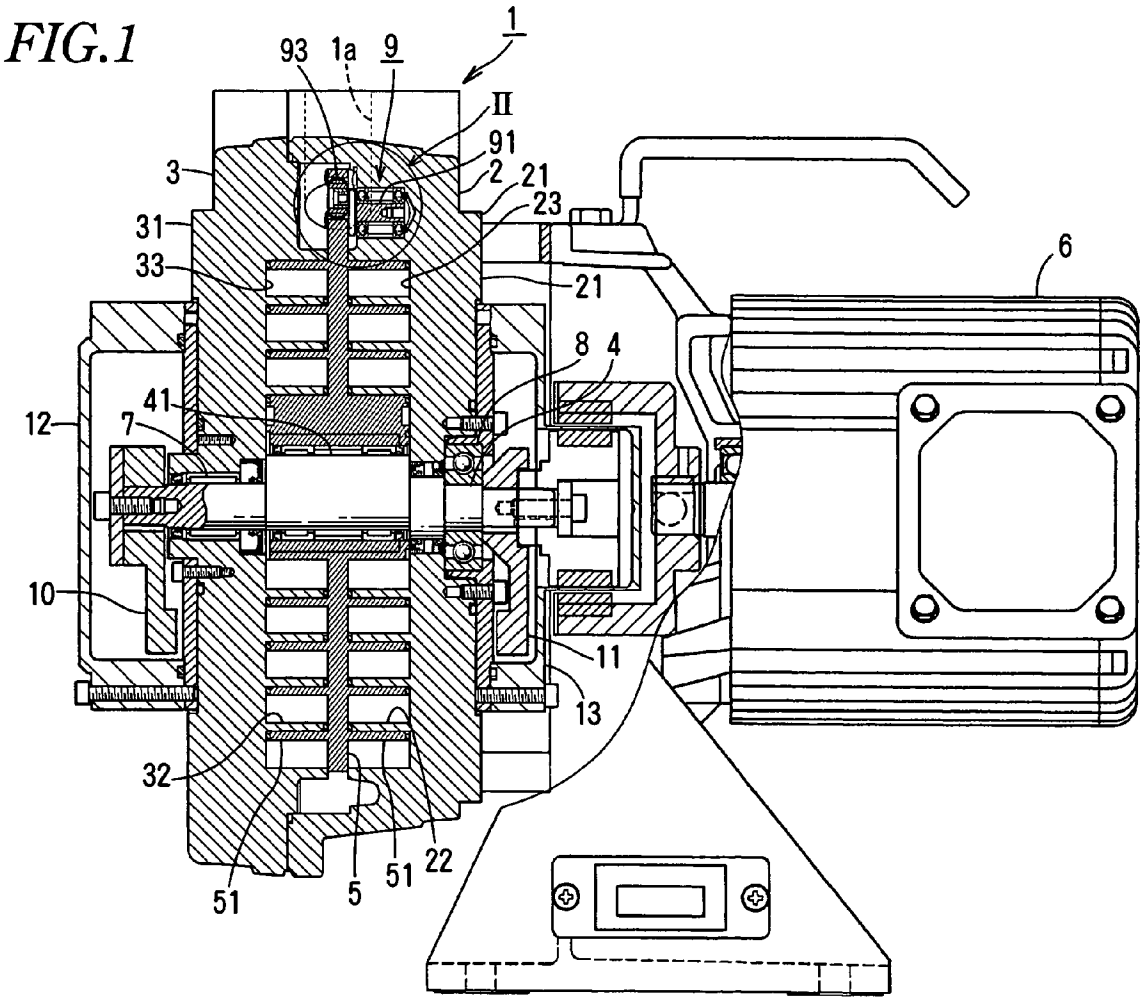
FIG. 1 is a vertical sectional view of an embodiment of a scroll fluid machine according to the present invention.

A housing 1 comprises a rear casing 2 and a front cover 3 and has a sealed chamber therein. The housing 1 has an intake port 1*a* on the outer circumference for sucking external air into the sealed chamber and a discharge port (not shown) for discharging a compressed gas out of the sealed chamber.

The casing 2 and cover 3 comprises circular fixed end plates 21,31 facing each other. Spiral or involute-curved fixed wraps 22,32 are provided on the opposite surfaces of the fixed end plates 21,31 respectively to constitute fixed scrolls 23,33.

Between the fixed scrolls 23 and 33, an orbiting scroll 5 is rotatably mounted around an eccentric axial portion 41 of a driving shaft 4 at the center of the housing 1. The driving shaft 4 is connected to a motor 6 at the rear end and is rotatably mounted via bearings 7,8 at the center of the fixed end plates 21,31.

The orbiting scroll 5 has orbiting wraps 51,51 which engage with the fixed wraps 22,32 by 180 degrees and is connected to the fixed scroll 23 with three self-rotation-preventing devices 9 equally spaced on the circumference.

The driving shaft 4 is rotated by the motor 6, so that the orbiting scroll 5 is revolved to allow a compression chamber defined by the fixed wraps 22,32 and orbiting wraps 51,51 to decrease in volume towards the center, thereby compressing air sucked through the intake port 1*a* to allow it to be discharged finally from the discharge port in the vicinity of the center.

Balancing weights 10,11 are formed on the driving shaft 4 at the front and rear ends close to the fixed end plates 31,21 to make rotation of the driving shaft 4 smooth.

Covering members 13,12 are mounted on the rear surface of the casing 2 and front surface of the cover 3 to cover the exposed ends of the driving shaft 4 from the housing 1 and balancing weights 11,10 thereby preventing compressed gas from leaking from the housing 1.

Figure 2:
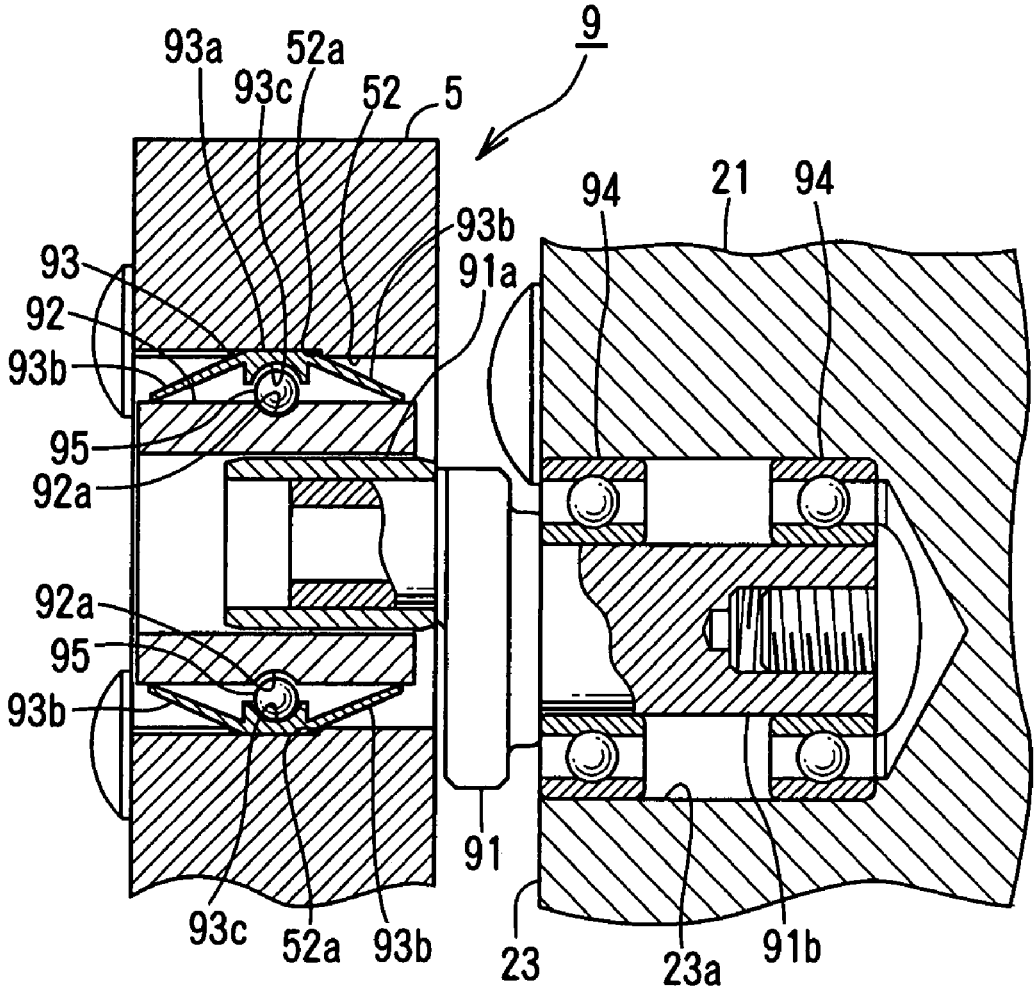
FIG. 2 is an enlarged view of part 11 in FIG. 1.

With respect to FIG. 2, the self-rotation-preventing device 9 will be described.

The self-rotation-preventing device 9 prevents the orbiting scroll 5 from rotating on its own axis to allow the orbiting scroll 5 to revolve with respect to the fixed scroll 23. The self-rotation-preventing device 9 comprises a crank pin 91 for connecting the orbiting scroll 5 to the fixed scroll 23; a sliding bearing 92 for rotatably mounting an axial portion 91*a* of the crank pin 91 in a support hole 52 of the orbiting scroll 5; and an adjusting member 93 for correcting an error in orbiting motion between the scrolls 5 and 23 owing to tolerance or thermal expansion.

The crank pin 91 comprises an orbiting-side axial portion 91*a* and a fixing-side axial portion 91*b*, each having equal eccentric distance from the eccentric axial portion 41 of the driving shaft 4.

The sliding bearing 92 has an external diameter smaller than an internal diameter of the support hole 52, is prevented from loosening axially in the support hole 52 and is elastically supported to move radially.

The orbiting-side axial portion 91*a* of the crank pin 91 is rotatably supported on the sliding bearing 92 elastically supported in the support hole 52 of the orbiting scroll 5 via the adjusting member 93. The fixing-side axial portion 91*b* is rotatably supported in the support hole 23*a* of the fixed scroll 23 via ball bearings 94,94.

Figure 3:
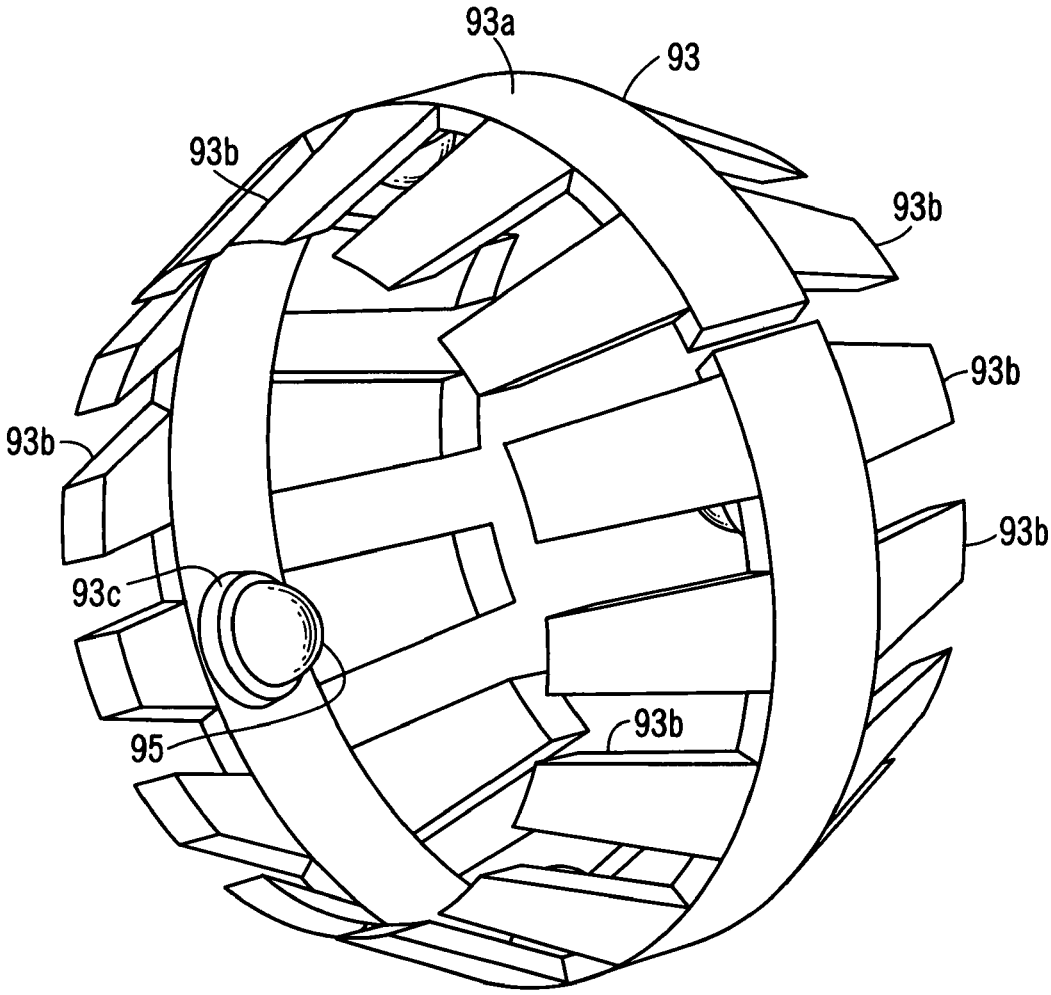
FIG. 3 is a perspective view of an adjusting member.

The adjusting member 93 is made of wear-resistant elastic metal and comprises a ring 93*a* which pressingly fits in the support hole 52 of the orbiting scroll 5. A plurality of elastic protrusions 93*b* axially projects from the ring 93*a* to contact the outer circumferential surface of the sliding bearing 92 to support the sliding bearing 92 elastically. The ring 93*a* is partially cut so that it can be deformed elastically in a circumferential direction in FIG. 3.

The ring 93*a* is pressingly fitted in the support hole 52 of the orbiting scroll 5 and positioned in the support hole 52 by engaging in a stepped portion 52*a*. Thus, the adjusting member 93 is held not to loosen axially in the support hole 52. In order that the adjusting member 93 does not loosen axially, a groove may be formed instead of the stepped portion 52*a*.

On the inner circumferential surface of the ring 93*a*, three ball-receiving portions 93*c* are equally spaced circumferentially. On the outer circumferential surface of the sliding bearing 92, three concave portions 92*a* face the ball-receiving portion 93*c*.

Between the elastic protrusions 93*b* and 93*b*, a metal ball 95 is received in the ball-receiving portion 93*c* and in the concave portion 92*a* to prevent the sliding bearing 92 from loosening axially with respect to the adjusting member 93.

The ball 95 has a diameter smaller than a gap between the ball-receiving portion 93*c* and the concave portion 92*a* not to hinder the sliding bearing 92 from moving radially.

The elastic protrusion 93*b* is elastically deformed in a radial direction and contacts the outer circumferential surface of the sliding bearing 92 to support the sliding bearing 92 in the support hole 52 of the orbiting scroll elastically. Under severe condition, the sliding bearing 92 can be moved radially against the elastic protrusion 93*b* made of metal and elastically deformed independently thereby correcting an error in orbiting motion between the scrolls 5 and 23.

The ball 95 is interposed between the opposite elastic protrusions 93*b* and 93*b*, so that the elastic protrusion 93*b* uniformly act on the sliding bearing 92 thereby holding the sliding bearing 92 in the support hole 52 stably.

The embodiment relates to a both-side scroll fluid machine in which the orbiting scroll 5 is interposed between the two fixed scrolls 23 and 33. The present invention may apply to a one-side scroll fluid machine in which a one-side fixed scroll engages with a one-side orbiting scroll.

The foregoing merely relates to an embodiment of the invention. Various changes and modifications may be made by a person skilled in the art without departing from the scope of claims wherein:

What is claimed is:

1. A scroll fluid machine comprising:

a fixed scroll having a fixed wrap and a first support hole;

an orbiting scroll having a second support hole and an orbiting wrap which engages with the fixed wrap to form a compression chamber; and a self-rotation-preventing device disposed in the first support hole of the fixed scroll and the second support hole of the orbiting scroll to prevent the orbiting scroll from rotating on its own axis, said self-rotation-preventing device comprising a bearing in the second support hole of the orbiting scroll, a crank pin in which one axial portion is rotatably supported by the bearing and the other axial portion is rotatably supported by the first support hole of the fixed scroll, and an adjusting member interposed between an inner circumferential surface of the second support hole and an outer circumferential surface of the bearing to correct an error in orbiting motion between the fixed scroll and the orbiting scroll, said adjusting member being made of metal ring that pressingly fits in the second support hole of the orbiting scroll, said ring having a plurality of elastic protrusions that axially project on each side of the ring to elastically support the bearing.

2. A scroll fluid machine of claim 1 wherein the adjusting member engages with a stepped portion on the inner circumferential surface of the second support hole.

3. A scroll fluid machine of claim 1 wherein the adjusting member further comprises a stopper interposed between an inner circumferential surface of the ring and a recess on the outer circumferential surface of the bearing to prevent the bearing from moving axially.

4. A scroll fluid machine of claim 3 wherein the stopper comprises a metal ball.

5. A scroll fluid machine of claim 1 wherein said plurality of elastic protrusions are elastically deformed separately.

* * * * *